US011046336B2

(12) United States Patent
Wang et al.

(10) Patent No.: US 11,046,336 B2
(45) **Date of Patent: *Jun. 29, 2021**

(54) CHASSIS COMPONENT OF RAILWAY VEHICLE, AND RAILWAY VEHICLE

(71) Applicant: CRRC QINGDAO SIFANG CO., LTD., Qingdao (CN)

(72) Inventors: Xiaojie Wang, Qingdao (CN); Yu Wang, Qingdao (CN); Honglei Tian, Qingdao (CN); Haiyang Yu, Qingdao (CN); Longxi Liu, Qingdao (CN)

(73) Assignee: CRRC QINGDAO SIFANG CO., LTD., Qingdao (CN)

( * ) Notice: Subject to any disclaimer, the term of this patent is extended or adjusted under 35 U.S.C. 154(b) by 348 days.

This patent is subject to a terminal disclaimer.

(21) Appl. No.: 16/185,334

(22) Filed: Nov. 9, 2018

(65) Prior Publication Data

US 2019/0077424 A1 Mar. 14, 2019

(30) Foreign Application Priority Data

Sep. 6, 2018 (CN) ..... 201811038273.X

(51) Int. Cl.
*B61F 1/12* (2006.01)
*B61F 1/08* (2006.01)
(Continued)

(52) U.S. Cl.
CPC ..... *B61F 1/12* (2013.01); *B61F 1/08* (2013.01); *B61F 5/02* (2013.01); *B61F 5/16* (2013.01)

(58) Field of Classification Search
CPC ..... B61F 1/08; B61F 1/10; B61F 1/12; B61F 1/14; B61F 5/00; B61F 5/02; B61F 5/04; B61F 5/16
See application file for complete search history.

(56) References Cited

U.S. PATENT DOCUMENTS 3,770,139 A 11/1973 Glenn
3,831,530 A 8/1974 Cope et al.
(Continued)

FOREIGN PATENT DOCUMENTS

CN 101445117 A 6/2009
CN 101970275 A 2/2011
(Continued)

*Primary Examiner* — S. Joseph Morano
*Assistant Examiner* — Cheng Lin
(74) *Attorney, Agent, or Firm* — Cantor Colburn LLP

(57) ABSTRACT

The disclosure provides a chassis component of a railway vehicle, and a railway vehicle, the chassis including two lower boundary beams, the two lower boundary beams being provided at an interval; and a cross beam component, the cross beam component being provided between the two lower boundary beams, wherein there are a plurality of cross beam components, and the plurality of cross beam components are provided along a length direction of each of the lower boundary beams at an interval, wherein at least one cross beam component includes a first cross beam and a second cross beam provided below the first cross beam in a height direction of the each of the lower boundary beams, the first cross beam and the second cross beam form a mounting cavity, and a part of a floor of a railway vehicle penetrates into the mounting cavity.

18 Claims, 4 Drawing Sheets

(51) Int. Cl.
*B61F 5/16* (2006.01)
*B61F 5/02* (2006.01)

(56) References Cited

U.S. PATENT DOCUMENTS

| | | | | | |
|---|---|---|---|---|---|
| 3,859,928 | A | | 1/1975 | Adler | |
| 4,589,348 | A | * | 5/1986 | Holabeck | B61F 5/16 105/199.4 |
| 5,809,899 | A | * | 9/1998 | Kaufhold | B61F 5/18 105/199.4 |
| 6,324,995 | B1 | * | 12/2001 | Kaufhold | B61F 5/16 105/199.4 |
| 10,730,145 | B2 | * | 8/2020 | Han | B23K 31/125 |
| 2019/0084591 | A1 | * | 3/2019 | Wang | B61F 1/14 |

FOREIGN PATENT DOCUMENTS

| | | | | |
|---|---|---|---|---|
| CN | 102673591 | A | * | 9/2012 |
| CN | 102673591 | A | | 9/2012 |
| CN | 104029692 | A | | 9/2014 |
| CN | 104203708 | A | | 12/2014 |
| CN | 206288021 | U | * | 6/2017 |
| CN | 106964902 | A | | 7/2017 |
| CN | 107107921 | A | | 8/2017 |
| CN | 107618527 | A | | 1/2018 |
| CN | 107628050 | A | * | 1/2018 |
| CN | 107628050 | A | | 1/2018 |
| CN | 107914726 | A | * | 4/2018 |

* cited by examiner

CHASSIS COMPONENT OF RAILWAY VEHICLE, AND RAILWAY VEHICLE

CROSS REFERENCE TO RELATED APPLICATION

This application is related to and claims the benefit of Chinese Patent Application Number 201811038273.X filed on Sep. 6, 2018, the contents of which are incorporated herein by reference in their entirety.

TECHNICAL FIELD

The present disclosure relates to a field of railway vehicles, and in particular to a chassis component of a railway vehicle, and a railway vehicle.

BACKGROUND

A sleeper beam not only is a connecting part of a vehicle body and a bogie of a railway vehicle, but also is a main bearing part of a chassis component, which is used for transferring force and torque transferred from the bogie to the vehicle body.

A center pin of a traditional railway vehicle is provided on the bogie, and the center pin is in threaded connection with the sleeper beam through a screw. The sleeper beam in the related art includes two structural forms: a simple I-shaped structure and an overall box-type structure. In the above two sleeper beam structures, the sleeper beam having the I-shaped structure is low in strength, and cannot meet requirements for vehicle body load; the sleeper beam having the box-type structure is in threaded connection with the center pin on the bogie through a screw, the connecting strength between the center pin and the sleeper beam is insufficient, and during the long-term operation process of the railway vehicle, it is difficult to ensure the stability of a connecting structure due to the reasons such as vibration of the vehicle, so that the transfer of force and torque of the entire vehicle is affected.

SUMMARY

An embodiment of the present disclosure provides a chassis component of a railway vehicle and a railway vehicle, intendeds to solve the problem in the related art of insufficient connecting strength between a center pin and a web structure of a sleeper beam.

To this end, some embodiments of the present disclosure provide a chassis component of a railway vehicle. The chassis component includes: two spaced lower boundary beams; and two spaced sleeper beams, provided between the two lower boundary beams along a length direction of the lower boundary beam. At least one of the sleeper beams includes: a web structure; a center pin, connected with a bogie of a railway vehicle; and a mounting frame, connected with the web structure, the center pin being provided on the mounting frame, the mounting frame including a plurality of vertical plates, and the plurality of vertical plates being spaced along an outer wall surface of the center pin.

Some embodiments of the present disclosure provide a railway vehicle. The railway vehicle includes a vehicle body structure and a chassis component connected with the vehicle body structure, the chassis component being the above chassis component.

By applying the technical solution of the present disclosure, the plurality of vertical plates are provided on the outer wall surface of the center pin to form the mounting frame, so that the connecting area between the center pin and the web structure is increased, thus improving the connecting strength between the center pin and the web structure. Compared with the screw-based threaded connection between the center pin disposed on the bogie and the sleeper beam in the related art, in an embodiment of the present disclosure, the mounting frame is additionally provided to connect the center pin and the web structure of the sleeper beam, the plurality of vertical plates are used to increase the connecting strength between the mounting frame and the center pin, and then the mounting frame provided with the center pin is connected with the web structure, so that the connecting strength between the center pin and the web structure is improved, thus improving the overall strength of the sleeper beam.

BRIEF DESCRIPTION OF THE DRAWINGS

The accompanying drawings, which constitute a part of this application, are used to provide a further understanding of the present disclosure, and the exemplary embodiments of the present disclosure and the description thereof are used to explain the present disclosure, but do not constitute improper limitations to the present disclosure. In the drawings.

The drawings include the following reference signs:

10: sleeper beam; 11: center pin; 12: vertical plate; 13: rib plate; 131: bulge; 132: weight-reducing through hole; 14: web structure; 141: web; 142: wire passage hole; 15: upper cover plate; 151: through hole; 152: first penetration-out hole; 16: lower cover plate; 161: second penetration-out hole; 17: inner boundary beam; 20: lower boundary beam.

DETAILED DESCRIPTION OF THE EMBODIMENTS

It is to be noted that in the case of no conflict, the features in the embodiments and the embodiments in the present application may be combined with each other. The present disclosure is described below with reference to the drawings and in conjunction with the embodiments in detail.

Figure 1:
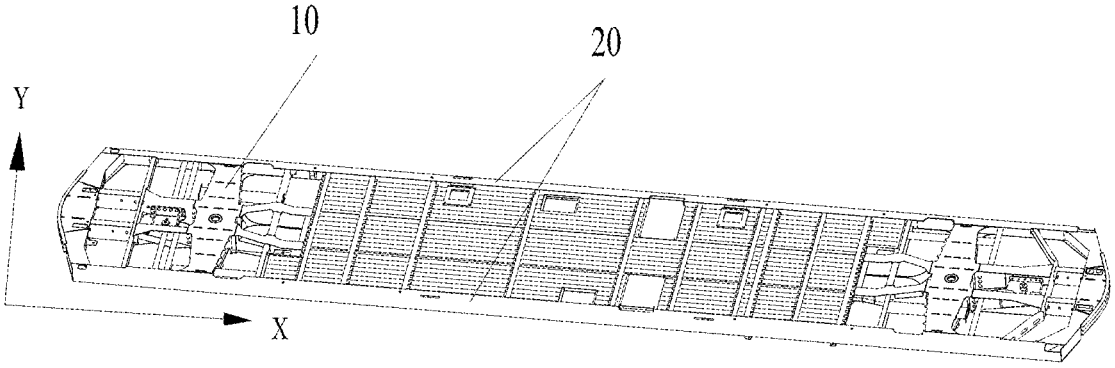
FIG. 1 illustrates a structural schematic diagram of a chassis component of a railway vehicle according to an embodiment of the present disclosure.

In the present disclosure and the embodiments of the present disclosure, as shown in FIG. 1, a length direction of a chassis component is an X direction, and a width direction of the chassis component is a Y direction.

Figure 3:
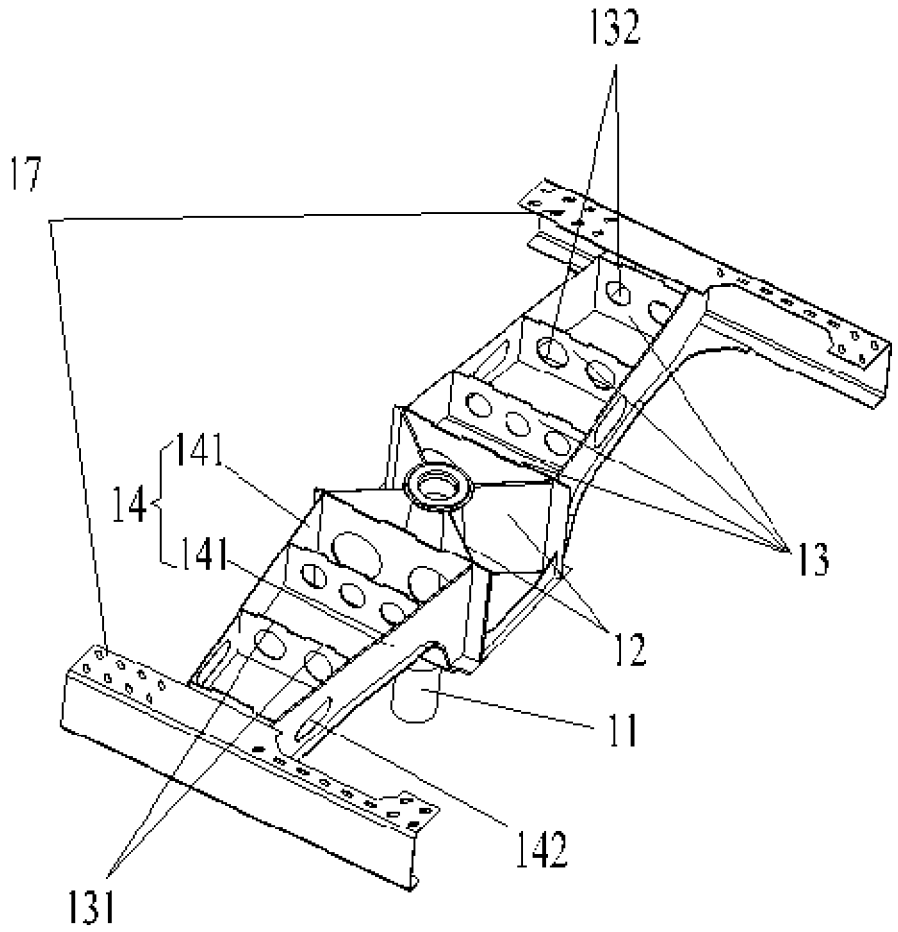
FIG. 3 illustrates a partial structural schematic diagram of the sleeper beam in FIG. 2 (where an upper cover plate is removed)

As shown in FIG. 1 and FIG. 3, an embodiment of the present disclosure provides a chassis component of a railway vehicle. The chassis component of the present embodiment includes two spaced lower boundary beams 20 and two spaced sleeper beams 10. The two spaced sleeper beams 10 are provided between the two lower boundary beams 20 along a length direction of the lower boundary beams 20, and at least one of the sleeper beams 10 includes a web structure 14, a center pin 11 and a mounting frame. The center pin 11 is connected with a bogie of a railway vehicle, the mounting frame is connected with the web structure 14, the center pin 11 is provided on the mounting frame, the mounting frame includes a plurality of vertical plates 12, and the plurality of vertical plates 12 are provided along an outer wall surface of the center pin 11 at intervals.

In an embodiment of the present application, the plurality of vertical plates 12 are provided on the outer wall surface of the center pin 11 to form the mounting frame, so that the connecting area between the center pin 11 and the web structure 14 is increased, thus improving the connecting strength between the center pin 11 and the web structure 14. Compared with the screw-based threaded connection between the center pin provided on the bogie and the sleeper beam in the related art, in an embodiment of the present application, the mounting frame is additionally provided to connect the center pin 11 and the web structure 14 of the sleeper beam 10, the plurality of vertical plates 12 are used to increase the connecting strength between the mounting frame and the center pin 11, and then the mounting frame provided with the center pin 11 is connected to the web structure 14, so that the connecting strength between the center pin 11 and the web structure 14 is improved, thus improving the overall strength of the sleeper beam 10.

In an exemplary embodiment not illustrated in the drawings of the present disclosure, one sleeper beam 10 includes a web structure 14, a center pin 11 and a mounting frame. The center pin 11 is connected with a bogie of a railway vehicle, the mounting frame is connected with the web structure 14, the center pin 11 is provided on the mounting frame, the mounting frame includes a plurality of vertical plates 12, and the plurality of vertical plates 12 are provided along an outer wall surface of the center pin 11 at intervals. The other sleeper beam 10 can use the above structure, or the structure in the related art.

Figure 6:
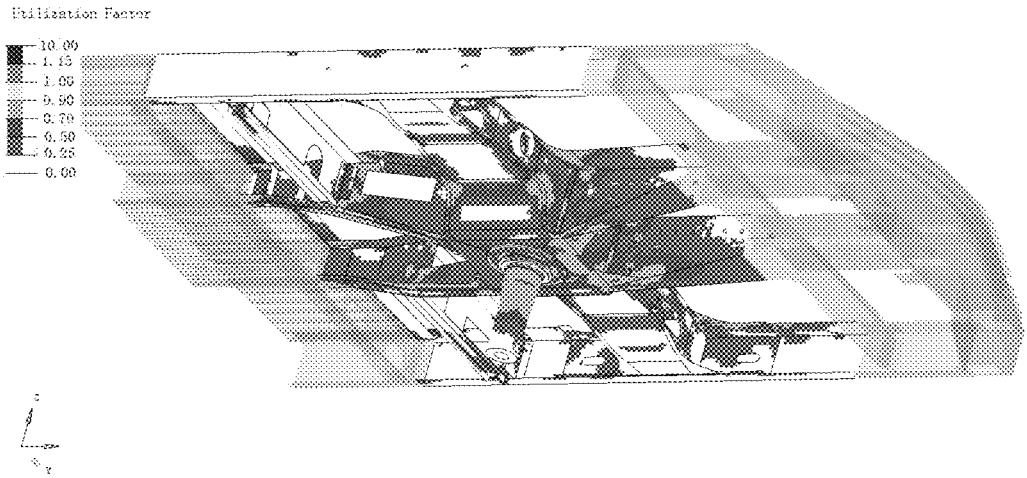
FIG. 6 illustrates a stress nephogram of a partial chassis component of a railway vehicle according to an embodiment of the present disclosure.
Figure 7:
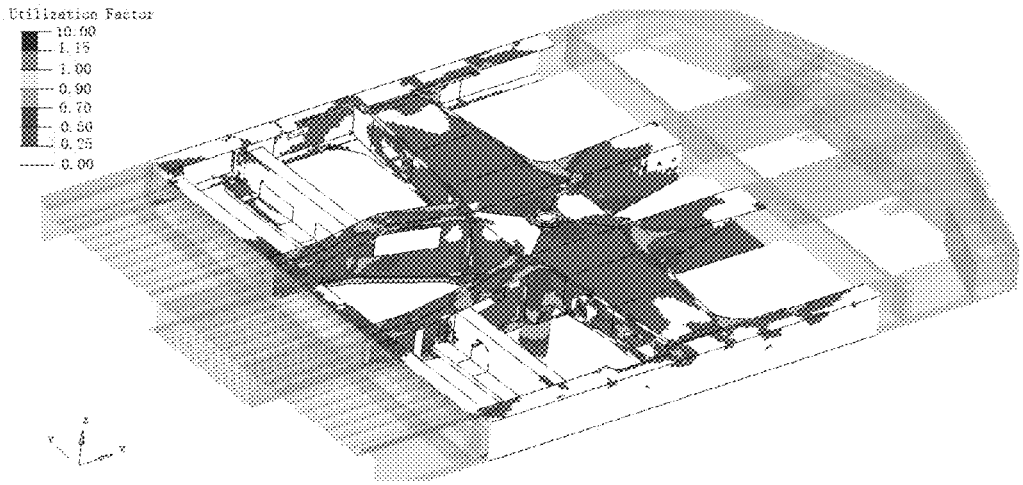
FIG. 7 illustrates a stress nephogram of FIG. 6 in another direction.

In an exemplary embodiment, as shown in FIG. 6 and FIG. 7, a joint between the sleeper beam 10 and the center pin 11 on the chassis component of the railway vehicle is a stress concentration area on the chassis component. During the operation process of the railway vehicle, it is necessary to ensure the connecting strength between the center pin 11 and the sleeper beam 10, so as to ensure that the center pin 11 can stably transfer force and torque from the bogie. Therefore, the center pin 11 in the embodiment of the present disclosure is connected with the web structure 14 of the sleeper beam 10 through the mounting frame, the connecting strength is good, the connection is firm, and the normal operation of the railway vehicle is ensured.

As shown in FIG. 3, in the embodiment of the present disclosure, the plurality of vertical plates 12 are provided on the outer wall surface of the center pin 11 in an X shape, each vertical plate 12 being welded to the outer wall surface of the center pin 11.

In an exemplary embodiment, the mounting frame is composed of four vertical plates 12, the four vertical plates 12 being provided on the outer wall surface of the center pin 11 in an X shape. The arrangement improves the strength of the mounting frame, and the four vertical plates 12 simultaneously support the center pin 11, thereby improving the connecting strength between the center pin 11 and the mounting frame. Thus, when the mounting frame provided with the center pin 11 is subsequently assembled to the web structure 14, the center pin 11 is not separated from the mounting frame, and can be better connected with the bogie.

In an exemplary embodiment, the four vertical plates 12 are welded to the outer wall surface of the center pin 11 respectively, and compared with bolt connection between the center pin and the sleeper beam in the related art, the connecting mode of the embodiment of the present disclosure is firmer. The four vertical plates 12 and the center pin 11 are welded together to form a whole, thereby ensuring the overall strength of the sleeper beam 10.

Of course, in an alternative embodiment not illustrated in the drawings of the present disclosure, the number of vertical plates 12 of the mounting frame is not limited to 4, and can be appropriately set according to the internal space of the sleeper beam 10.

As shown in FIG. 3, in the embodiment of the present disclosure, the at least one of the sleeper beams 10 includes two web structures 14, the mounting frame being located between the two web structures 14.

In an exemplary embodiment of the present disclosure, the mounting frame is located between the two web structures 14, and the mounting frame is connected with the two web structures 14 respectively, so that two ends of the mounting frame are fixed, and the stability of the mounting frame is improved, thus ensuring the stability of connection between the center pin 11 and the web structure 14 of the sleeper beam 10.

As shown in FIG. 3, in an exemplary embodiment of the present disclosure, the each of the sleeper beam 10 further includes a plurality of rib plates 13, the web structure 14 includes two spaced webs 141, and the plurality of rib plates 13 are provided between the two webs 141 at intervals.

In an exemplary embodiment, there is an included angle between the two webs 141 of the web structure 14, and a spacing between the two webs 141 is gradually reduced along a direction away from the mounting frame.

The plurality of rib plates 13 are provided between the two webs 141, and in an exemplary embodiment, the plurality of rib plates 13 are provided between the two webs 141 in parallel. The arrangement improves the structural strength of the sleeper beam 10, and the plurality of rib plates 13 can effectively share an action force transferred to the sleeper beam 10, thereby improving the bearing capacity of the sleeper beam 10.

Of course, in an alternative embodiment not illustrated in the drawings of the present disclosure, the plurality of rib plates 13 provided between the two webs 141 may form an included angle, and a specific arrangement mode may be selected according to the bearing situation of the sleeper beam 10.

As shown in FIG. 3, in an embodiment of the present disclosure, each of the web structures 14 is connected with at least one vertical plate 12 of the mounting frame through at least one rib plate 13.

In an exemplary embodiment, the each of the web structures 14 is connected with the two vertical plates 12 of the mounting frame through an outermost rib plate 13, that is, the rib plate 13 closest to the mounting frame is connected with the two vertical plates 12, and the rib plate 13 is connected with the two webs 141 of the web structure 14.

In the arrangement, the mounting frame is connected with the web structure 14 through the rib plate 13. Compared with direct connection between the mounting frame and the web structure 14, the arrangement mode of the present application converts line-to-line connection between the mounting frame and the web structure 14 into line-to-surface connection between the vertical plate 12 and the rib plate 13 and line-to-surface connection between the web 141 and the rib plate 13, so that the connecting strength between the mounting frame and the web structure 14 is improved, and the stability of connection between the mounting frame and the web structure 14 is ensured, thus ensuring the stability of connection between the center pin 11 and the web structure 14.

As shown in FIG. 3, in an embodiment of the present disclosure, at least one rib plate 13 included in the plurality of rib plates 13 is provided with a weight-reducing through hole 132.

In an exemplary embodiment, each of the rib plates 13 is provided with a weight-reducing through hole 132.

On the premise of ensuring that the rib plate 13 can improve the strength of the sleeper beam 10, the weight of the rib plate 13 is reduced, thus realizing the light weight of the sleeper beam 10, and reducing the weight of the chassis component. Further, by providing the weight-reducing through hole 132, the transfer of the impact force can be stopped when the vehicle body is impacted, thereby avoiding damage to a rear end of the vehicle body caused by the impact force, and improving the safety of the vehicle body.

Of course, in an alternative embodiment not illustrated in the drawings of the present disclosure, the size of the rib plate 13 may be designed as required, and the weight-reducing through hole 132 may also be provided on a part of the rib plates 13, so as to ensure the strength of the sleeper beam 10 and reduce the weight of the sleeper beam 10.

Figure 4:
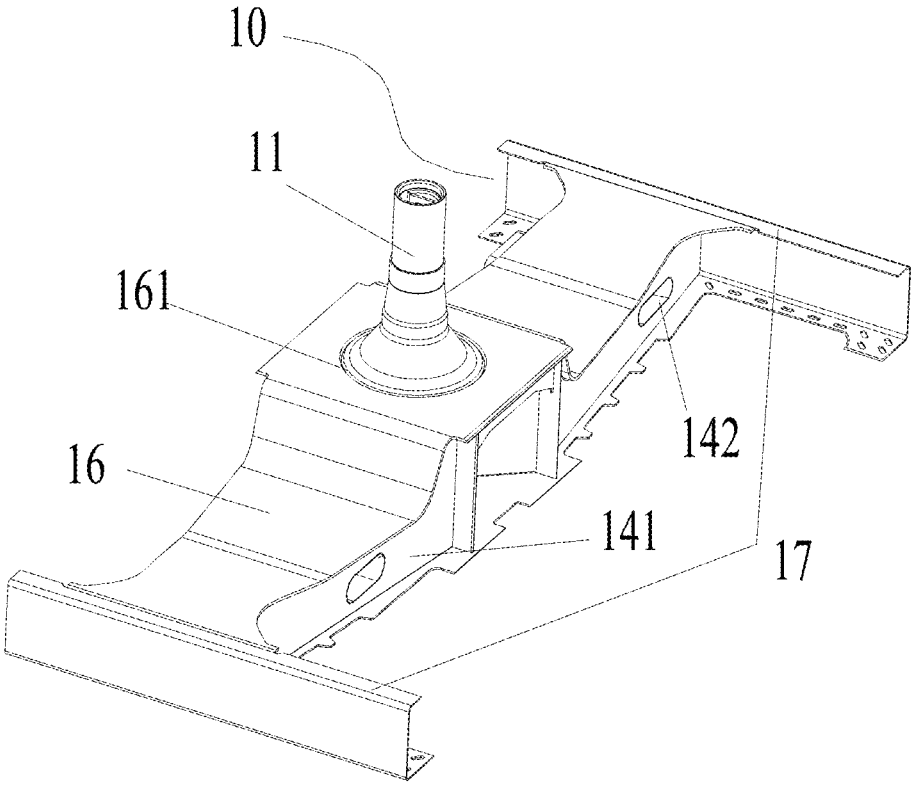
FIG. 4 illustrates a structural schematic diagram of the sleeper beam in FIG. 2 in another direction.

As shown in FIG. 3 and FIG. 4, in the embodiment of the present disclosure, each web 141 is provided with a wire passage hole 142.

A wire harness may pass through the chassis component of the railway vehicle, and in order to facilitate the connection and penetration of the wire harness, a wire passage hole 142 is provided on the web 141 for the penetration out or in of the wire harness.

In an exemplary embodiment, the wire passage holes 142 on the two webs 141 of the web structure 14 are correspondingly provided to facilitate the penetration of the wire harness. In an exemplary embodiment, a pipeline for wire passage may penetrate into the wire passage hole 142, so that the wire harness penetrates into the pipeline for the storage of the wire harness, thereby avoiding damage to the wire harness caused by wire harness exposure.

Figure 2:
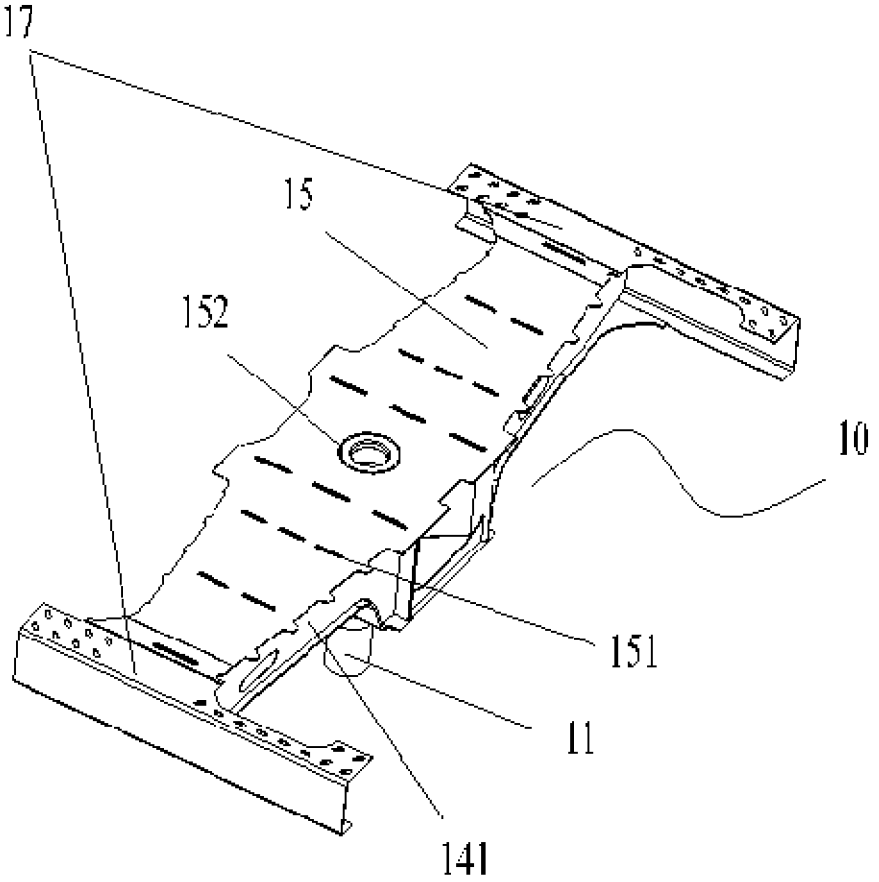
FIG. 2 illustrates a structural schematic diagram of a sleeper beam of the chassis component in FIG. 1.

As shown in FIG. 2, in the embodiment of the present disclosure, the at least one of the sleeper beams 10 further includes an upper cover plate 15 covering the webs 141, the upper cover plate 15 is provided with a plurality of through holes 151, at least one of the rib plates 13 is provided with a bulge 131, and the bulge 131 matches the corresponding through hole 151.

Figure 5:
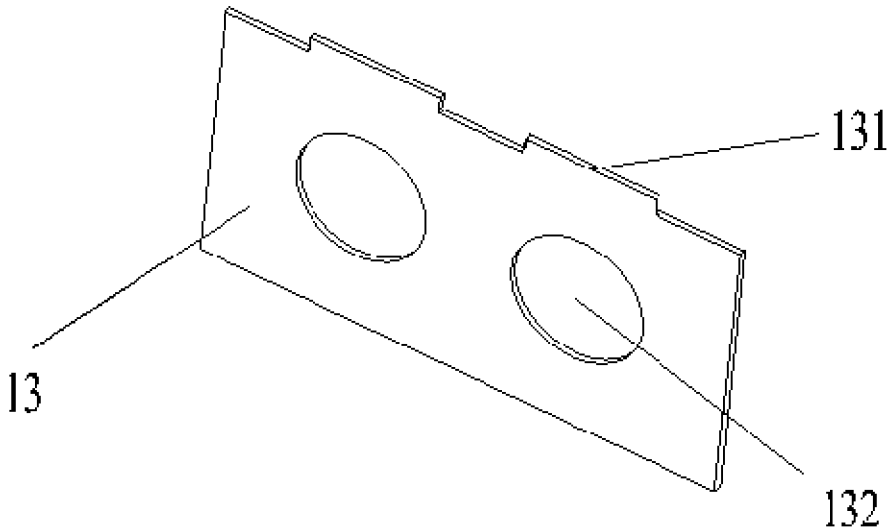
FIG. 5 illustrates a structural schematic diagram of a rib plate of the sleeper beam in FIG. 2.

In an exemplary embodiment, as shown in FIG. 5, each rib plate 13 is provided with a bulge 131, and the upper cover plate 15 is provided with multiple through holes 151 in one-to-one correspondence with the multiple bulges 131. By means of the arrangement, after the upper cover plate 15 covers the webs 141, the bulges 131 on the rib plates 13 are in inserted fit with the through holes 151 on the upper cover plate 15, so as to connect the upper cover plate 15 and the rib plates 13 together. Thus, the upper cover plate 15 covers a cavity defined by the web structure 14 and the rib plates 13, so as to form a box structure of the sleeper beam 10.

In an exemplary embodiment, in order to ensure the connecting strength between the upper cover plate 15 and the rib plate 13, after the bulges 131 are in inserted fit with the through holes 151, the fit part is welded, so as to further ensure the connecting strength between the upper cover plate 15 and the rib plate 13, thereby ensuring the overall strength of the sleeper beam 10.

As shown in FIG. 2, in an embodiment of the present disclosure, the upper cover plate 15 is provided with a first penetration-out hole 152, one end of the center pin 11 penetrating out of the first penetration-out hole 152.

The arrangement ensures the fit between the center pin 11 and the upper cover plate 15, the first penetration-out hole 152 limits the center pin 11, and it is ensured that the center pin 11 is pivoted to the bogie provided at a lower part of the chassis component.

As shown in FIG. 4, in an embodiment of the present disclosure, the at least one of the sleeper beams 10 further includes a lower cover plate 16 provided at a lower part of the webs 141, the lower cover plate 16 being fixedly connected with each rib plate 13.

In the present application, the upper cover plate 15 corresponds to the lower cover plate 16, and the upper cover plate 15, the lower cover plate 16 and the web structure 14 jointly form a box structure. In an exemplary embodiment, the lower cover plate 16 is fixedly connected with each rib plate 13, thereby ensuring the stability of connection between the rib plate 13 and the lower cover plate 16.

In an exemplary embodiment, each of the webs 141 is welded to the lower cover plate 16, the rib plate 13 is welded to the webs 141, and after the upper cover plate 15 is in inserted fit with each rib plate 13, welding fixing is performed. The arrangement makes the sleeper beam 10 form a stable whole structure, and ensures the overall strength of the sleeper beam 10.

As shown in FIG. 4, in an exemplary embodiment of the present disclosure, the lower cover plate 16 is provided with a second penetration-out hole 161, the other end of the center pin 11 penetrating out of the second penetration-out hole 161.

The arrangement ensures the connection between the center pin 11 and the bogie provided at the lower part of the chassis component, thus ensuring that the sleeper beam 10 may transfer force and torque transferred from the bogie to the vehicle body.

As shown in FIG. 1 and FIG. 2, in an exemplary embodiment of the present disclosure, the at least one of the sleeper beams 10 further includes two spaced inner boundary beams 17, the two inner boundary beams 17 being in one-to-one corresponding connection with the two lower boundary beams 20.

In a width direction of the chassis component, the two inner boundary beams 17 are spaced at two ends of the sleeper beam 10. Moreover, the two inner boundary beams 17 are in one-to-one corresponding connection with the two lower boundary beams 20 respectively so as to connect the sleeper beam 10 and the lower boundary beams 20.

In an exemplary embodiment, each of the inner boundary beams 17 is welded to the corresponding lower boundary beam 20, thereby ensuring the connecting strength between the sleeper beam 10 and the lower boundary beam 20.

As shown in FIG. 3, in an exemplary embodiment of the present disclosure, each of the inner boundary beams 17 is connected with two webs 141 of at least one web structure 14.

In an exemplary embodiment the present disclosure, the sleeper beam 10 includes two web structures 14, the two web structures 14 being located on two sides of the mounting frame respectively. The inner boundary beams 17 located on a same side of the mounting frame are welded to the two webs 141 of the web structure 14 respectively.

The arrangement forms a complete cavity inside the sleeper beam 10, and the web 141 is welded to the inner boundary beam 17, thus ensuring the overall strength of the sleeper beam 10.

The embodiment of the present disclosure also provides a railway vehicle. The railway vehicle of the present embodiment includes a vehicle body structure and a chassis component connected with the vehicle body structure, the chassis component being the above chassis component.

In the chassis component of some embodiments of the present disclosure, the mounting frame is additionally provided to connect the center pin 11 and the web structure 14 of the sleeper beam 10, a plurality of vertical plates 12 are used to increase the connecting strength between the mounting frame and the center pin 11, and then the mounting frame provided with the center pin 11 is connected with the web structure 14, so that the connecting strength between the center pin 11 and the web structure 14 is improved, thus improving the overall strength of the sleeper beam 10. Therefore, the railway vehicle having the above chassis component also has the above advantages.

The technical solution of an embodiment of the present disclosure is implemented by the following modes.

1. A plurality of vertical plates 12 are provided on the outer wall surface of a center pin 11 to form an X-shaped mounting frame, and the mounting frame connects the center pin 11 and a web structure 14 into a whole. The plurality of vertical plates 12 are welded to the center pin 11, the multiple vertical plates 12 are welded to one of rib plates 13, and the web structure 14 is welded to the one of rib plate 13, so as to fixedly connect the center pin 11 and the web structure 14. Compared with the related art in which a center pin of a bogie and a sleeper beam are connected through a bolt, the connection mode of the embodiment of the present disclosure is firmer.

2. The rib plate 13 is provided inside a sleeper beam 10, the lower end of the rib plate 13 is welded to a lower cover plate 16, the upper end of the rib plate 13 is provided with a bulge 131 and is inserted into a through hole 151 on an upper cover plate 15, and the insertion part is welded, so that the connecting strength between the rib plate 13 and the upper cover plate 15 is ensured, thus improving the overall strength of the sleeper beam 10.

From the above description, it can be seen that the above embodiment of the present disclosure achieves the following technical effects: the plurality of vertical plates are provided on the outer wall surface of the center pin to form the mounting frame, so that the connecting area between the center pin and the web structure is increased, thus improving the connecting strength between the center pin and the web structure. Compared with the screw-based threaded connection between the center pin disposed on the bogie and the sleeper beam in the related art, in the present application, the mounting frame is additionally provided to connect the center pin and the web structure of the sleeper beam, the plurality of vertical plates are used to increase the connecting strength between the mounting frame and the center pin, and then the mounting frame provided with the center pin is connected to the web structure, so that the connecting strength between the center pin and the web structure is improved, thus improving the overall strength of the sleeper beam.

The above is only the preferred embodiments of the present disclosure, not intended to limit the present disclosure. As will occur to those skilled in the art, the present disclosure is susceptible to various modifications and changes. Any modifications, equivalent replacements, improvements and the like made within the spirit and principle of the present disclosure shall fall within the scope of protection of the present disclosure.

What is claimed is:

1. A chassis component of a railway vehicle, the chassis component comprising:

two spaced lower boundary beams (20); and two spaced sleeper beams (10), provided between the two lower boundary beams (20) along a length direction of the lower boundary beams (20), at least one of the sleeper beams (10) comprising:

a web structure (14);

a center pin (11), connected with a bogie of a railway vehicle; and a mounting frame, connected with the web structure (14), the center pin (11) being provided on the mounting frame, the mounting frame comprising a plurality of vertical plates (12), and the plurality of vertical plates (12) being spaced along an outer wall surface of the center pin (11), the plurality of vertical plates (12) are provided on the outer wall surface of the center pin (11) in an X shape, each vertical plate (12) being welded to the outer wall surface of the center pin (11).

2. The chassis component as claimed in claim 1, wherein the at least one of the sleeper beams (10) comprises two web structures (14), the mounting frame being located between the two web structures (14).

3. The chassis component as claimed in claim 2, wherein the at least one of the sleeper beams (10) further comprises a plurality of rib plates (13), each of the web structures (14) comprises two spaced webs (141), and the plurality of rib plates (13) are provided between the two webs (141) at intervals.

4. The chassis component as claimed in claim 3, wherein the web structure (14) is connected with at least one of the vertical plates (12) of the mounting frame through at least one of the plurality of rib plates (13).

5. The chassis component as claimed in claim 3, wherein at least one rib plate (13) in the plurality of rib plates (13) is provided with a weight-reducing through hole (132).

6. The chassis component as claimed in claim 5, wherein each of the webs (141) is provided with a wire passage hole (142).

7. The chassis component as claimed in claim 3, wherein the at least one of the sleeper beams (10) further comprises an upper cover plate (15) covering the web (141), the upper cover plate (15) is provided with a plurality of through holes (151), at least one of the rib plates (13) is provided with a bulge (131), and the bulge (131) matches the corresponding through hole (151).

8. The chassis component as claimed in claim 7, wherein the upper cover plate (15) is provided with a first penetration-out hole (152), and one end of the center pin (11) penetrates out of the first penetration-out hole (152).

9. The chassis component as claimed in claim 8, wherein the at least one of the sleeper beams (10) further comprises a lower cover plate (16) provided at a lower part of the two webs (141), the lower cover plate (16) being fixedly connected with each rib plate (13).

10. The chassis component as claimed in claim 9, wherein the lower cover plate (16) is provided with a second penetration-out hole (161), and the other end of the center pin (11) penetrates out of the second penetration-out hole (161).

11. The chassis component as claimed in claim 3, wherein the at least one of the sleeper beams (10) further comprises two spaced inner boundary beams (17), the two inner boundary beams (17) being in one-to-one corresponding connection with the two lower boundary beams (20).

12. The chassis component as claimed in claim 11, wherein each of the inner boundary beams (17) is connected with the two webs (141) of at least one of the web structures (14).

13. The chassis component as claimed in claim 4, wherein each of the sleeper beams (10) further comprises two spaced inner boundary beams (17), the two inner boundary beams (17) being in one-to-one corresponding connection with the two lower boundary beams (20).

14. The chassis component as claimed in claim 5, wherein each of the sleeper beams (10) further comprises two spaced inner boundary beams (17), the two inner boundary beams (17) being in one-to-one corresponding connection with the two lower boundary beams (20).

15. The chassis component as claimed in claim 6, wherein each of the sleeper beams (10) further comprises two spaced inner boundary beams (17), the two inner boundary beams (17) being in one-to-one corresponding connection with the two lower boundary beams (20).

16. The chassis component as claimed in claim 7, wherein each of the sleeper beams (10) further comprises two spaced inner boundary beams (17), the two inner boundary beams (17) being in one-to-one corresponding connection with the two lower boundary beams (20).

17. The chassis component as claimed in claim 8, wherein each of the sleeper beams (10) further comprises two spaced inner boundary beams (17), the two inner boundary beams (17) being in one-to-one corresponding connection with the two lower boundary beams (20).

18. A railway vehicle, comprising a vehicle body structure and a chassis component connected with the vehicle body structure, wherein the chassis component is the chassis component as claimed in claim 1.

* * * * *